United States Patent [19]

Willis

[11] Patent Number: 4,910,807

[45] Date of Patent: Mar. 27, 1990

[54] RATCHET ADJUSTMENT MECHANISM FOR BATH WASTE AND OVERFLOW SYSTEMS

[75] Inventor: Brian P. Willis, Kansas City, Mo.

[73] Assignee: Watco Manufacturing Company, Kansas City, Mo.

[21] Appl. No.: 321,725

[22] Filed: Mar. 10, 1989

[51] Int. Cl.[4] ..... E03C 1/24; E03C 1/22

[52] U.S. Cl. ..... 4/199; 4/204; 74/527; 137/315; 137/872; 403/105

[58] Field of Search ..... 4/199, 200, 201, 202, 4/203, 204, DIG. 7, 197, 198, 405, 411, 413; 74/527, 578, 586; 403/104, 105, 107, 108, 379, 378; 137/315, 872; 128/205.24

[56] References Cited

U.S. PATENT DOCUMENTS

| | | | |
|---|---|---|---|
| 3,125,764 | 3/1964 | Young | 4/204 |
| 3,366,980 | 2/1968 | Petursson et al. | 4/295 |
| 3,392,409 | 7/1968 | Politz | 4/199 |
| 3,428,295 | 2/1969 | Downey et al. | 251/144 |
| 3,463,512 | 9/1965 | Politz | 251/74 |
| 3,471,873 | 10/1969 | Politz | 4/199 |
| 3,995,333 | 12/1976 | Stephens | 4/286 |
| 4,007,500 | 2/1977 | Thompson et al. | 4/295 |
| 4,103,372 | 8/1978 | Cuschera | 4/286 |
| 4,276,662 | 7/1981 | Young | 4/295 |
| 4,339,832 | 7/1982 | Cuschera | 4/287 |
| 4,352,213 | 10/1982 | Watts | 4/191 |
| 4,412,361 | 11/1983 | Cuschera | 4/286 |

FOREIGN PATENT DOCUMENTS

| | | | |
|---|---|---|---|
| 200322 | 10/1938 | Switzerland | 4/405 |

*Primary Examiner*—Henry J. Recla
*Assistant Examiner*—James Barrow

[57] ABSTRACT

In a trip lever bath waste and overflow system, a valve actuating linkage having a ratchet mechanism for easy length adjustment of the linkage. The ratchet mechanism includes a toothed rod which telescopes into a sleeve equipped with a wire clip serving as a pawl. After the linkage has been inserted into the overflow, the trip lever can be actuated to cause the rod to retract into the sleeve until the linkage assumes the proper length. The one way nature of the ratchet mechanism allows this retraction and also maintains the linkage in the proper length following initial adjustment.

4 Claims, 2 Drawing Sheets

RATCHET ADJUSTMENT MECHANISM FOR BATH WASTE AND OVERFLOW SYSTEMS

BACKGROUND AND SUMMARY OF THE INVENTION

This invention relates generally to a bath waste and overflow system and more particularly to an improved valve control linkage having a ratchet construction that facilitates length adjustment of the linkage.

Drainage from bath tubs is commonly controlled by what is known in the plumbing industry as a trip lever bath waste and overflow. The plumbing in this type of system includes a drain ell which extends horizontally from the bottom drain port of the tub. The end wall of the tub has an elevated overflow port from which an overflow ell extends downwardly. The drain and overflow ells are connected by a T fitting which also provides a valve seat for a valve which is known as a drop cylinder. The drop cylinder is carried on a linkage which typically takes the form of two brass rods and a clevis. A trip lever mounted on the overflow plate on the end wall of the tub is manipulated to actuate the linkage and raise and lower the drop cylinder between open and closed positions to control the tub drainage.

Because bath tubs are not standardized, installation of the drainage system requires that the overflow ell be telescopically fitted in the top end of the T fitting and adjusted to accommodate the dimensions and construction of the tub. Consequently, the length of the valve control linkage must be variable in order to allow the drop cylinder to be properly seated and unseated when the system is installed on different styles of tubs. Conventionally, this length adjustment of the linkage is made possible by providing a threaded connection between the upper brass rod and the clevis. Even though this construction allows the linkage to be varied in its length, it is by no means an easy task to adjust the linkage so that it is exactly the proper length for each different installation. Adjustment can take several trial and error attempts and can require special trips to the installation site by the plumber. It can easily be appreciated that this can amount to substantial labor costs.

U.S. Pat. No. 4,352,213 to Watts makes reference to these problems and discloses a linkage adjustment system that allows the linkage to be quickly, easily and accurately adjusted. The present invention provides a different linkage construction which is equally, if not more easily, installed in the proper manner.

It is the principal goal of the invention to provide a linkage adjustment mechanism which allows the bath waste and overflow linkage to be accurately adjusted after it has been placed in the overflow tube assembly. By virtue of the ratchet construction that is provided on the linkage, the linkage can be inserted and then adjusted simply by operating the trip lever. This automatically retracts the linkage to the proper length, and the one way nature of the ratchet mechanism thereafter maintains it at the length required to achieve proper valving action of the drop cylinder.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
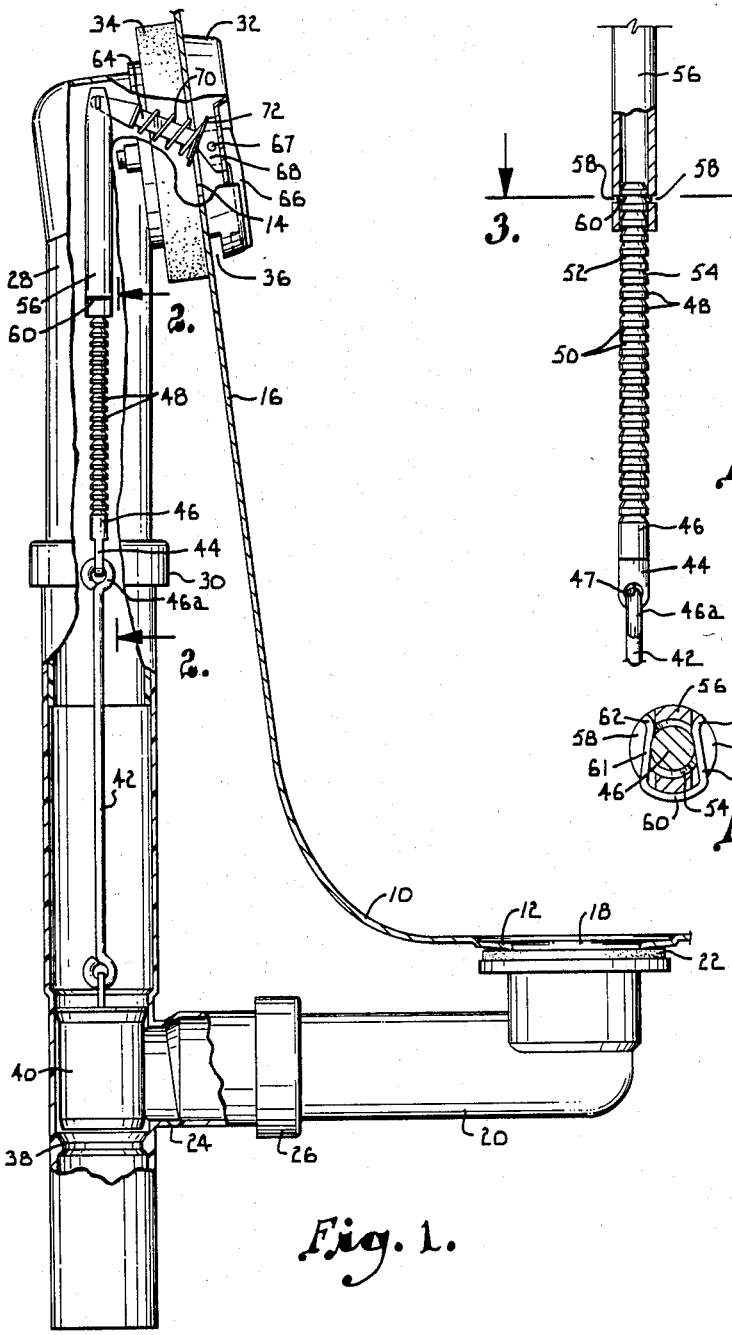
FIG. 1 is a fragmentary side elevational view of a trip lever bath waste and overflow drain system which is equipped with a valve actuating linkage constructed according to a preferred embodiment of the present invention, with the linkage in its position immediately after having been inserted in the overflow tubes prior to adjustment and with portions broken away and shown in section for purposes of illustration.

Referring now to the drawings in more detail and initially to FIG. 1, numeral 10 designates a conventional bath tub having the usual drain port 12 in its bottom surface and an elevated overflow port 14 in one end wall 16 of the tub. The drain system for the tub includes a strainer assembly having a strainer body 18 which extends through the drain port 12 and is threaded into the top end of a drain ell 20. A gasket 22 is fitted around the strainer body 18 and it is sealed against the underside of the tub bottom by a flange on the top end of the drain ell 20.

The drain ell 20 extends generally horizontally to provide drainage. Its end is received in the horizontal portion of a T fitting 24. A nut 26 is threaded onto the T fitting at the connection between the T fitting and the drain ell to assure a proper connection.

The top end of the vertical portion of the T fitting 24 telescopically receives an overflow ell 28. A nut 30 is threaded onto the top end of the T fitting at its junction with the overflow ell 28. The top end of the overflow ell 28 is secured to the tub end wall 16 in registration with the overflow port 14. A circular overflow plate 32 is screwed to the overflow ell in the usual fashion, with a washer 34 compressed against the outer surface of the tub end wall 16 by a flange on the ell 28. The overflow plate has an opening 36 on its lower portion which communicates wth the overflow port 14 in order to direct water into the overflow ell 28 before it rises to a level high enough to overflow the tub. The bottom end of the T fitting 24 connects with additional drain pipes which form part of the drain system of the building.

Figure 4:
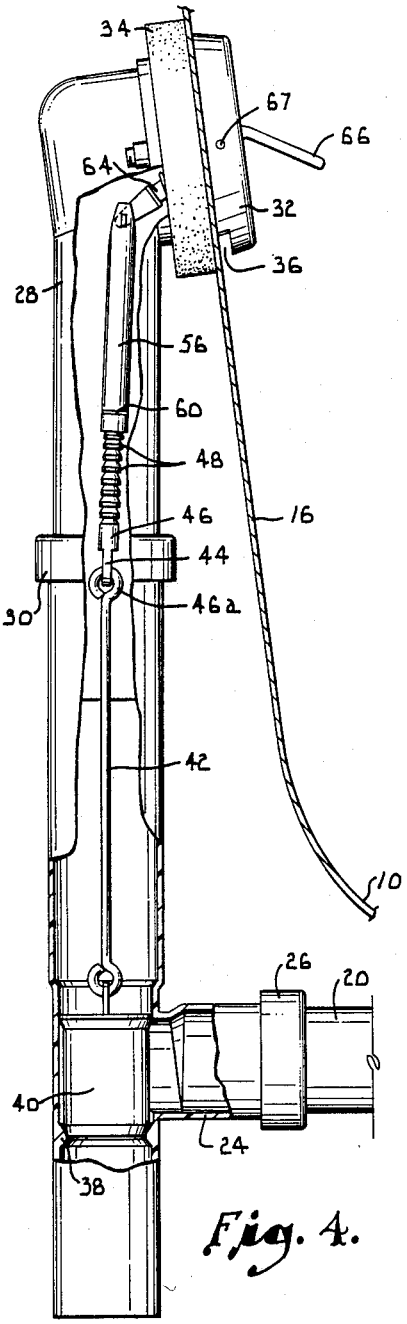
FIG. 4 is a fragmentary elevational view similar to FIG. 1, but with the trip lever raised to seat the drop cylinder and automatically adjust the length of the linkage, with portions being broken away and shown in section for purposes of illustration.

An annular valve seat 38 is formed in the T fitting 24 by a bead which projects inwardly from the wall of the vertical portion of the T fitting immediately below its junction with the horizontal portion. A drop cylinder 40 serves as a valve which may be raised and lowered between open and closed positions to open and close the drain port 12 in the usual manner. In the closed position of the drop cylinder, it seats on the valve seat 38 as shown in FIG. 4. In the open position, the drop cylinder is raised above seat 38. The drop cylinder 40 is hollow so that water from the overflow port 14 can drain through it regardless of its position.

In accordance with the present invention, the drop cylinder 40 is carried on and controlled by a special actuating linkage that includes a brass rod 42 on its lower end. Rod 42 is hooked at its lower end to the drop valve 40 and at its upper end to a lug 44 formed on the bottom end of a special rod 46. An eye 46a on the upper end of rod 42 extends through an opening 47 in the lug 44 (see FIG. 2).

Figure 2:
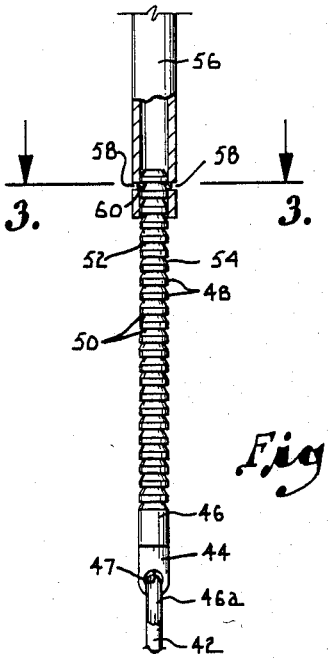
FIG. 2 is a fragmentary elevational view on an enlarged scale of the ratchet mechanism included in the linkage.

The rod 46 forms part of a ratchet mechanism and includes a plurality of external teeth 48 which are best shown in FIG. 2. Each tooth 48 angles outwardly and downwardly, and notches 50 are formed between the adjacent teeth. Each notch 50 is bounded at its upper end by a flat annular surface formed on the underside of the overlying tooth 48. The inside of each notch is formed by a frustoconical surface 54 of the tooth which inclines outwardly from top to bottom. The teeth 48 extend along substantially the entire length of the rod 46.

Figure 3:
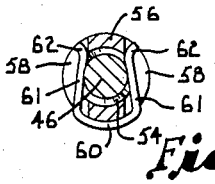
FIG. 3 is a fragmentary sectional view on an enlarged scale taken generally along line 3—3 of FIG. 2 in the direction of the arrows.

The actuating linkage includes a hollow sleeve 56 which closely receives the rod 46 in a telescopic manner. Near its lower end, the sleeve 56 is provided with a pair of opposing slots 58. A U-shaped wire clip 60 serves as a pawl for the ratchet mechanism and has opposing legs 61 which are fitted closely in the slots 58, as best shown in FIG. 3. The ends of the legs curl outwardly at 62. The wire clip 60 has a spring construction which causes its legs 61 to be continuously urged inwardly toward one another by spring action.

As best shown in FIG. 1, the top end of sleeve 56 is pinned to an arm 64 which is rigid at its front end with a trip lever 66. The trip lever and arm are pivoted at 67 to a bracket 68 or the overflow plate 32 such that lifting of the trip lever 66 causes the back end of arm 64 to move downwardly. Conversely, when the trip lever 66 is pushed downwardly, the back end of arm 64 is raised as the trip lever assembly pivots about the pivot connection 67.

A spring 70 is coiled around arm 64 and presses a plate 72 against the bracket 68. The fit of plate 72 against the edges of the bracket 68 provides a detent which tends to hold it in one of two positions, namely, the open and closed positions of the drop cylinder 40.

After the plumbing of the bath waste and overflow system has been installed in the usual manner, the inserted rod 46 is in the sleeve 56 far enough that the clip or pawl 60 is engaged in the uppermost notch 50 (see FIG. 2). The drop valve 40 and its actuating linkage can be inserted through the overflow port 14 and into the overflow ell 28 and the upper part of the T fitting 24. The trip lever 66 is at this time in its fully lowered position, as shown in FIG. 1. The overflow plate 32 is pressed against the end wall 16, and the screws are then applied to secure the overflow plate to the overflow ell 28.

The trip lever 66 is then pulled upwardly to the position shown in FIG. 4. After the drop cylinder 40 has seated on the valve seat 38, additional downward movement of the sleeve 56 causes rod 46 to retract into the sleeve. It is noted that the sloping surfaces 54 of the teeth are able to ride upwardly along the pawl 60 in order to accommodate retraction of rod 46 into sleeve 56. As the rod retracts, the pawl moves in ratcheting fashion into and out of the successive notches 50 between the teeth of the ratchet mechanism.

Once the trip lever 66 has been fully raised, rod 46 will be retracted into sleeve 56 to the extent necessary to provide the linkage with the proper overall length. At this point, the trip lever 66 is fully raised and the drop cylinder 40 is fully seated in its closed position. The trip lever 66 can thereafter be pivoted back downwardly, and this raises the back end of arm 64, thus raising the linkage and drop cylinder 40. It is noted that the pawl 60 is at this time seated in one of the notches 50 such that it pulls upwardly against the flat surface 52 on the underside of the immediately overlying tooth, thus lifting rod 46, eye bolt 44, rod 42 and the drop cylinder 40 along with sleeve 56. The one way nature of the ratchet mechanism allows retraction of the linkage during the initial adjustment and thereafter assures that the linkage remains at the proper length as the trip lever 66 is manipulated to open and close the bathtub drain.

Figure 5:
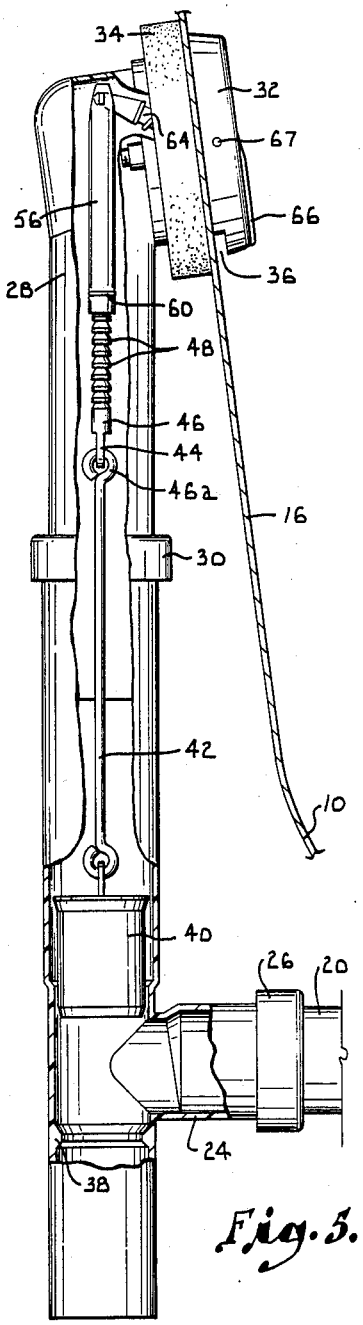
FIG. 5 is a fragmentary elevational view similar to FIG. 4, but showing the trip lever lowered to raise the drop cylinder from its seat to the fully open position.

In this manner, the ratchet mechanism permits the linkage to be quickly, easily and automatically adjusted to the proper length after the linkage has been installed in the overflow tube. Consequently, there is no need for trial and error attempts at adjusting the linkage, and considerable time and effort are saved in installing the bath waste and overflow system. When the trip lever 66 is operated, the drop valve 40 is moved between the seated or closed position shown in FIG. 4 and the fully open position shown in FIG. 5. When in the closed position, the drop cylinder blocks drainage through the drain port 12. In the open position, the drop cylinder is raised above the horizontal portion of T fitting 24, and water can drain from the tub in the normal fashion.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a bath waste and overflow arrangement of the type having a drain pipe for connection with a bathtub drain port and a pair of telescoping tubes connected to said drain pipe at one end thereof for general vertical extension from an opposite end thereof to said drain pipe from an overflow port in the bathtub, the improvement comprising:

a valve slidably inserted in said drain pipe for controlling drainage through said drain port;

a linkage connected to said valve for controlling the position of said valve, said linkage including a pair of links slidingly disposed in said telescoping tubes;

a trip lever movably mounted on said opposite end of said tubes between first and second positions and connected to for actuating said linkage to move said valve between open and closed positions corresponding, respectively, to said first and second positions ; and means for providing a ratchet connection between said links, said ratchet connection allowing said links to retract relative to one another while in said telescoping tubes to thereby effect adjustment of the length of said linkage between said lever and valve such that said valve will open and close corresponding to said first and second positions of said lever.

2. The improvement of claim 1, wherein:

one of said links comprises a sleeve;

the other of said links comprises a rod received in said sleeve for telescopic retraction; and said ratchet connection comprises a plurality of angled teeth on said rod and a pawl on said sleeve engaging said teeth in a manner allowing telescopic retraction of the rod into the sleeve but preventing extension of the rod out of the sleeve.

3. In a bath waste and overflow arrangement having a drain pipe adapted to extend from a bath tub drain port, an overflow tube adapted to extend from an overflow port in the bathtub, a junction between said drain pipe and said overflow tube presenting a valve seat, a valve movable onto and off of said valve seat to respectively close and open the drain pipe, and a trip lever movably mounted to the over flow tube adjacent said overflow port between extreme positions to effect opening and closing of said valve, the improvement comprising:

a linkage having a lower end carrying said valve thereon and an upper end coupled with said trip lever in a manner to lower said valve onto the valve seat and raise the valve off of the valve seat in response to movement of said trip lever to its extreme postions, said linkage including a pair of link members;

means for providing a ratchet connection between said link members arranged to allow relative retraction of the link while in the overflow tube in a manner to effect adjustment of the linkage to a length at which the valve is lowered onto the seat at one extreme position of the trip lever and raised off of the seat that the other extreme position of the trip lever.

4. The improvement of claim 3, comprising:

one of said link members comprises a sleeve;

the other of said link members comprises a rod received in said sleeve for telescopic retraction; and said ratchet connection comprises a plurality of angled teeth on said rod and a pawl on said sleeve engaging said teeth in a manner allowing telescopic retraction of the rod into the sleeve but preventing extension of the rod out of the sleeve.

* * * * *